US008220986B2

(12) United States Patent
Janz et al.

(10) Patent No.: US 8,220,986 B2
(45) Date of Patent: Jul. 17, 2012

(54) HIGH EFFICIENCY MIXER-IMPELLER

(75) Inventors: Eric Edward Antonio Janz, Clearcreek Township, OH (US); Kevin J. Myers, Dayton, OH (US); William Fryers, Overseal (GB); Julian B. Fasano, Troy, OH (US)

(73) Assignee: Chemineer, Inc., Dayton, OH (US)

( * ) Notice: Subject to any disclaimer, the term of this patent is extended or adjusted under 35 U.S.C. 154(b) by 842 days.

(21) Appl. No.: 12/274,064

(22) Filed: Nov. 19, 2008

(65) Prior Publication Data

US 2010/0124147 A1 May 20, 2010

(51) Int. Cl.
*B01F 7/00* (2006.01)

(52) U.S. Cl. ..... 366/330.3; 366/330.1; 366/330.5; 416/237

(58) Field of Classification Search ..... 366/330.1, 366/330.3, 330.5; 416/237, 235, DIG. 3, 416/210 R See application file for complete search history.

(56) References Cited

U.S. PATENT DOCUMENTS

| | | | |
|---|---|---|---|
| 1,838,453 | A | 12/1931 | Rosen |
| 4,468,130 | A | 8/1984 | Weetman |
| 5,052,892 | A | 10/1991 | Fasano |
| 5,052,982 | A | 10/1991 | Ouchi |
| 5,344,235 | A | 9/1994 | Weetman et al. |
| 5,813,837 | A | 9/1998 | Yamamoto et al. |
| 6,796,707 | B2 | 9/2004 | Gigas et al. |
| 7,278,598 | B2 | 10/2007 | Katz et al. |
| 7,374,333 | B2 | 5/2008 | Eisenkraetzer et al. |

FOREIGN PATENT DOCUMENTS

| | | | |
|---|---|---|---|
| DE | 2643560 | | 3/1978 |
| EP | 0542713 | | 5/1993 |
| WO | WO 00/35570 | * | 6/2000 |

OTHER PUBLICATIONS

PCT, International Preliminary Report on Patentability, International Application No. PCT/US2009/064662, (Jun. 3, 2011).
PCT, International Search Report and Written Opinion, International Application No. PCT/US2009/064662, 15 pages (Mar. 9, 2010).
"HE-3 High-Efficiency Impeller," Chemineer Bulletin 713, by Chemineer, Inc. (2 pages) (1996).
"SC-3 High Efficiency Impeller—Optimal Design . . . Maximum Results," Chemineer Bulletin 716-A, by Chemineer, Inc. (2 pages) (2003).
Web pages featuring Impellers, http://www.chemineer.com/impellers.php (9 pages) (Nov. 5, 2008).

* cited by examiner

*Primary Examiner* — Robert J Hill, Jr.
*Assistant Examiner* — Ninh Le
(74) *Attorney, Agent, or Firm* — Thompson Hine L.L.P.

(57) ABSTRACT

A mixer impeller having high efficiency blades. The impeller may include a central hub and a plurality of blades attached to and extending radially outwardly from the hub such that leading edges thereof are inclined upwardly from trailing edges thereof. Each of the blades may include a root attached to the hub, a tip, a first crease extending along substantially an entire length of the blade dividing the blade into a leading portion and a trailing portion, the leading and trailing portions meeting at the first crease such that the leading portion is angled downwardly from the trailing portion, and a second crease extending from a portion of the leading edge of the leading portion between the root and the tip diagonally along the leading portion to the tip, the second crease intersecting the tip at a point spaced from a point where the first crease intersects the tip, the second crease forming a tip portion of the leading portion that needs a remainder of the leading portion such that the tip portion is angled downwardly from the leading portion.

18 Claims, 6 Drawing Sheets

HIGH EFFICIENCY MIXER-IMPELLER

BACKGROUND

This disclosure relates generally to mixers for mixing fluids, and more particularly, to mixer impellers for such mixing devices.

Mixer impellers are used to mix, blend and agitate fluids and fluids with suspended solids in tanks or other vessels. Mixer impellers typically are mounted on a shaft driven by a motor that may be located outside the tank or vessel.

A mixer impeller may include a hub, adapted to be mounted on the shaft, and a plurality of blades extending radially outwardly from the hub in a plane perpendicular to the axis of rotation of the shaft and hub. The blades may be formed integrally with the hub, or alternatively, the blades may be bolted to flanges formed on the hub.

In a typical configuration, a mixer impeller is mounted on a shaft oriented vertically and centrally within a cylindrical tank so that the mixer impeller is concentric with the circular inner walls of the tank. Alternatively, a mixer impeller may be mounted on a shaft that extends sidewardly through a wall of a tank or vessel.

It is often desirable to design a mixer impeller such that the blades thereof maximize pumping efficiency, which is the ratio of the axial thrust developed by the impeller blades to the horsepower required to rotate the shaft. Accordingly, radial and rotational fluid flow resulting from operation of the impeller should be minimized. By increasing the efficiency of a mixer impeller, the horsepower required to achieve a given mixing rate may be reduced, thereby saving energy and equipment costs necessary to achieve a given performance level.

In addition, a higher efficiency impeller can achieve the same mixing effect with a smaller blade length, thereby reducing equipment costs. It is also desirable to design a mixer impeller wherein the mixing efficiency varies minimally relative to changes in the ratio of the impeller diameter to tank diameter, for applications in which the impeller is mounted concentrically within a cylindrical mixing tank.

SUMMARY

This disclosure is directed to a high-efficiency mixer impeller and blade configurations thereof. In one aspect, the mixer impeller may include a central hub and a plurality of blades attached to and extending radially outwardly from the hub. The blades may be oriented such that the leading edges thereof are inclined upwardly from trailing edges thereof. Each of the blades has a root attached to the hub, a tip, and a first crease that may extend along substantially an entire length of the blade dividing the blade into a leading portion and a trailing portion, the leading and trailing portions may meet at the crease such that the leading portion is angled downwardly from the trailing portion.

Each blade may include a tip portion of the leading portion is separated from the remainder of the leading portion by a second crease that extends from a point on the leading edge of the leading portion between the root and the tip diagonally from the leading portion to the tip. The second crease intersects the tip at a point spaced from a point where the first crease intersects the tip. The tip portion meets the remainder of the leading portion such that the tip portion is angled downwardly from the leading portion.

In one aspect of the mixer impeller design, each of the blades may be cambered, in which the leading portion of the blade may make an angle of about 155° with the trailing portion of the blade along the first crease. In another aspect, the tip portion of each blade may make an angle of about 13.5° with the remainder of the leading portion of the blade. In a third aspect, the trailing portion of each blade may taper in width toward the blade tip.

The blades may be mounted on or otherwise extend from the hub such that a portion of the leading edge of each blade extending along the tip portion makes an angle of about 2° with a plane perpendicular to an axis of rotation of the hub. It may be desirable to bevel the leading edge of each blade of the impeller at an angle of about 45°.

The camber formed by the leading and trailing portions of the blades of the impeller meeting at an angle at the first crease may enable blades to be made of relatively thinner sheet material than, for example, an impeller having flat blades. Use of thinner material may enable smaller diameter shafts and smaller drive motors to be used to generate a given thrust, thus providing savings in equipment costs and energy required to operate a mixer utilizing the impeller.

DETAILED DESCRIPTION

Figure 1:
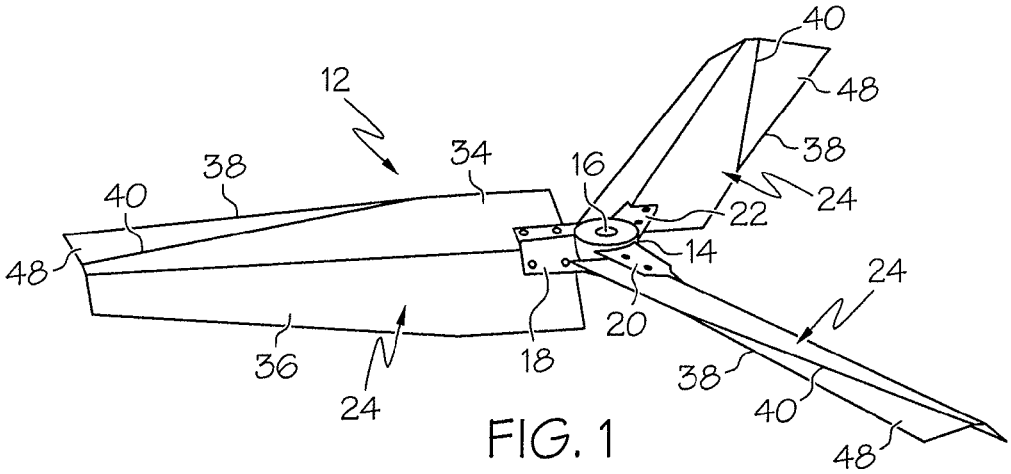
FIG. 1 is a perspective view of an embodiment of the disclosed mixer impeller.

As shown in FIG. 1, one aspect of the disclosed mixer impeller, generally designated 12, includes a hub 14 having a central orifice 16 adapted to receive the output shaft of a drive motor (not shown), and flanges 18, 20, 22, evenly spaced about the hub and each adapted to receive a blade 24.

Figure 2:
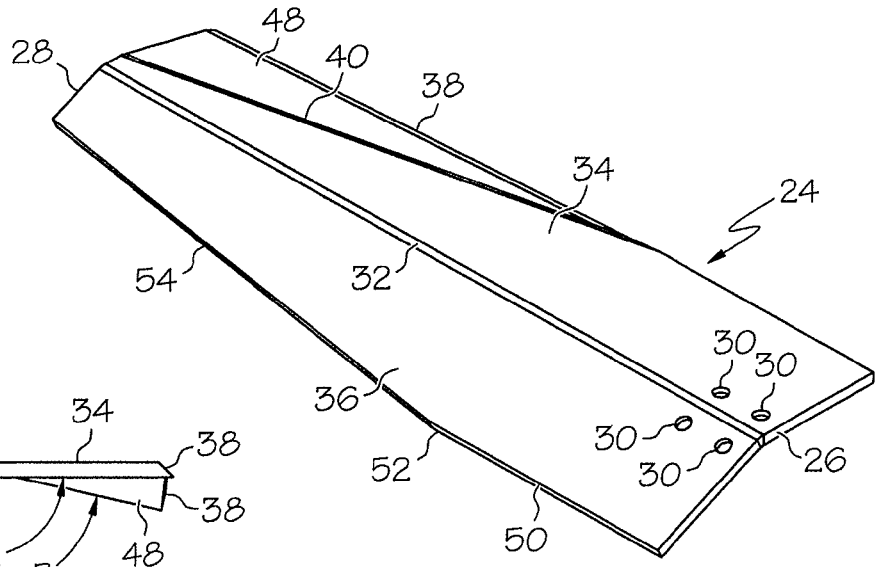
FIG. 2 is a perspective view of an impeller blade of the mixer impeller of FIG. 1.
Figure 4:
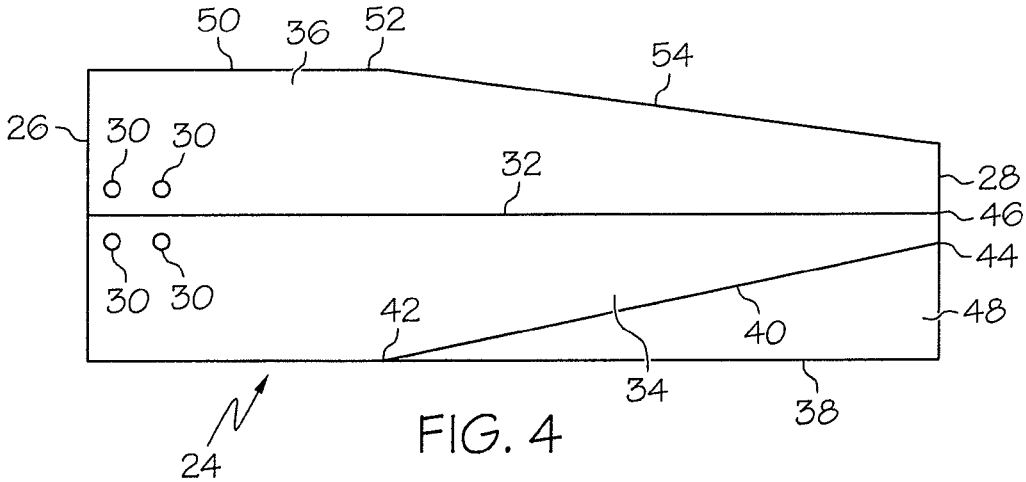
FIG. 4 is a top plan view of the impeller blade of FIG. 2.

As shown in FIGS. 2 and 4, each blade 24 includes a root 26 and a tip 28. The root 28 includes holes 30 that receive mounting bolts (not shown) that attach the blade to the flanges 18, 20, 22. Each blade 24 may include four mounting holes 30, as shown in FIGS. 1, 2 and 4, or two mounting holes for attachment to flanges having a corresponding number of mounting holes.

Figure 3:
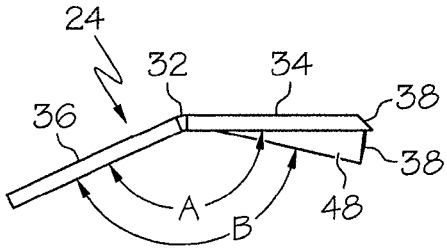
FIG. 3 is an elevational view of the impeller blade of FIG. 2 taken at the blade root.

As shown in FIGS. 2, 3 and 4, the blade 24 may be made of flat, sheet material that preferably is corrosion resistant, such as stainless steel or a metal coated with a corrosion-resistant coating. The blade includes a first crease 32 that may be generally linear and extend longitudinally from the root 26 to the tip 28 of the blade. As best shown in FIG. 4, the crease 32 may be centrally located along a mid-width of the blade 24.

The crease 32 may divide the blade 24 into a leading portion 34 and a trailing portion 36. The leading portion 34 may includes a leading edge 38. As shown in FIG. 3, leading edge 38 may be beveled at approximately a 45° angle with respect to the plane of leading portion 34.

Leading portion 34 may include a second crease 40 that may be generally linear and extend from a point 42 along the leading edge 38 between the root 26 and tip 28 to a point 44 on the tip that is spaced from the point 46 at which the first crease 32 intersects the tip 28. Crease 42 may form a bend line for tip portion 48, which is a part of the leading portion 34 and may be generally flat.

Thus, as shown in the figures, leading portion 34 is substantially flat and includes a tip portion 48 which itself is substantially flat and is angled relative to the remainder of the leading portion. As shown in FIG. 3, the leading portion 34 forms a camber with trailing portion 36 at an angle A that is preferably approximately 155 degrees. The tip portion 48 is angled at an angle B of approximately 166.5° relative to trailing portion 36. Put another way, the tip portion 48 forms an angle along a second crease 40 of approximately 13.5° with the remainder of the leading portion 34.

The camber formed by leading and trailing portions 34, 36, respectively, along first crease 32, adds beam strength to the blade 24 and enables the blade to be made from relatively thinner material than would be required to make a substantially flat blade that could withstand substantially the same loading.

The trailing portion 36 includes a trailing edge 50 that may taper in width toward the tip 28 from a point beginning at 52. The tapered portion 54 of the trailing edge 50 may begin at point 52, which may be located along the length of the blade 24 at a point comparable to point 42 for second crease 40. By tapering the width of the trailing portion 36, the power draw of the impeller may be reduced with only minimal decline in pumping capacity of the impeller 12.

The intersection points 46, 44 of the first and second creases 32, 40, respectively, preferably may be spaced from each other to facilitate fabrication of the blade. Such a spacing does not diminish the process performance of the mixer impeller 12 significantly.

The first crease 32, as shown in FIG. 3, may be formed by welding leading portion 34 and trailing portion 36 of the blade 24 together. Alternatively, the crease 32 may be formed simply by bending a plate of sheet material in the general shape of the blade 24 to form the crease. Similarly, the second crease 40 may be formed simply by bending the leading portion 34 of the blade 24 along the crease 40 to form the tip portion 48.

As shown in FIG. 1, the blades 24 are mounted on the flanges 18, 20, 22 such that the leading edge 38 of each blade along the tip portion forms an angle of approximately 2° to a plane of rotation of the mixer impeller 12 when mounted on a drive shaft (not shown), that is, along an axis of rotation of the hub 14.

The disclosed blade design provides advantages of high efficiency while being capable of being made lighter and using thinner gauge sheet material. The camber formed by bending the blade along the first crease 32 adds beam stiffness to the blade, while the tip portion 48 increases the efficiency of the impeller blade 24 without significantly decreasing the pumping capacity of an impeller 12 having such blades. These features may enable the mixer impeller 12 to be made of thinner material than prior art impellers having substantially flat blades, which reduces material costs in fabricating the impeller and enables use of a thinner impeller shaft, also a cost savings.

Figure 5:
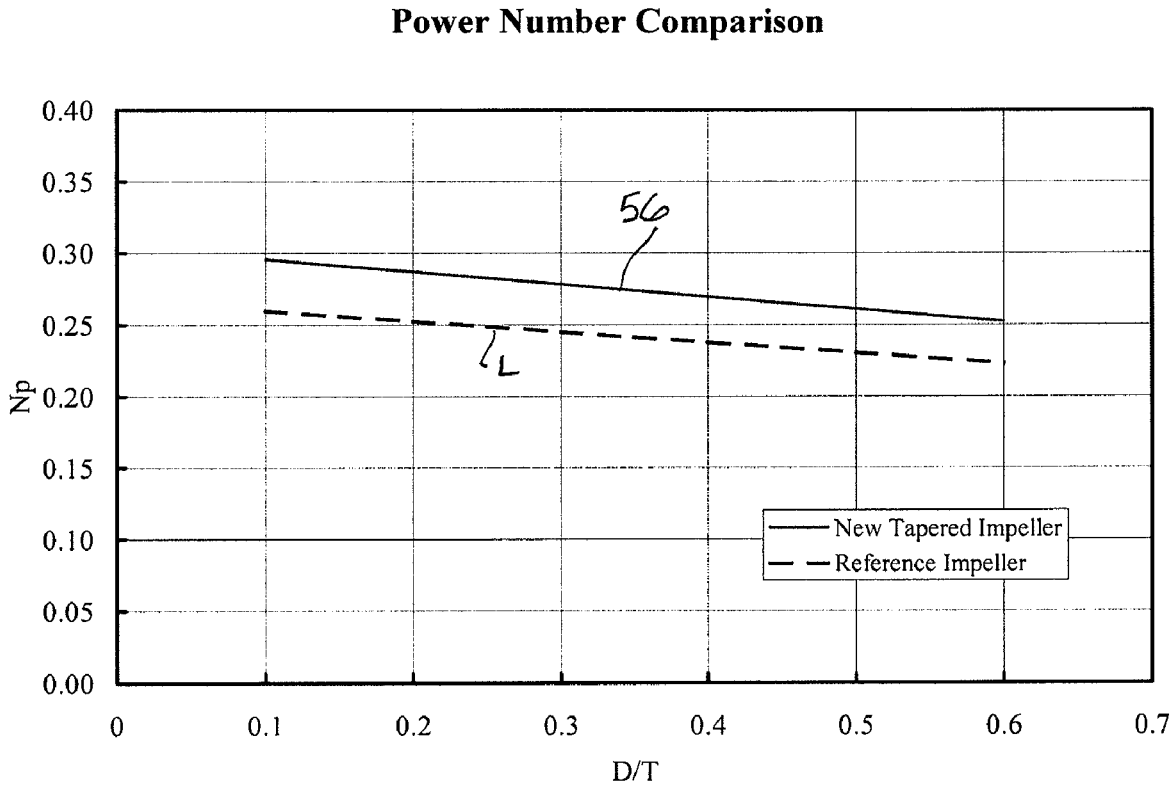
FIG. 5 is a graph of the power number versus impeller blade diameter to tank diameter (D/T) ratio for the disclosed impeller in comparison to a prior art impeller.

The increased efficiency and performance characteristics of the mixer impeller 12 (see FIG. 1) will now be shown and discussed with respect to the graphs of FIGS. 5-9. As shown in FIG. 5, the power number (Np) of the impeller 12 is plotted for various combinations of impeller diameter (D) and tank diameters (T) expressed as decimal ratios (D/T). The data points for the disclosed impeller 12 are linearized and shown as solid line 56. The slope of line 56 is relatively small. This indicates that the power number of the disclosed impeller 12 does not vary significantly for a variety of D/T ratios. Consequently, the disclosed impeller may be utilized in a variety of applications without a significant decrease in performance.

Figure 6:
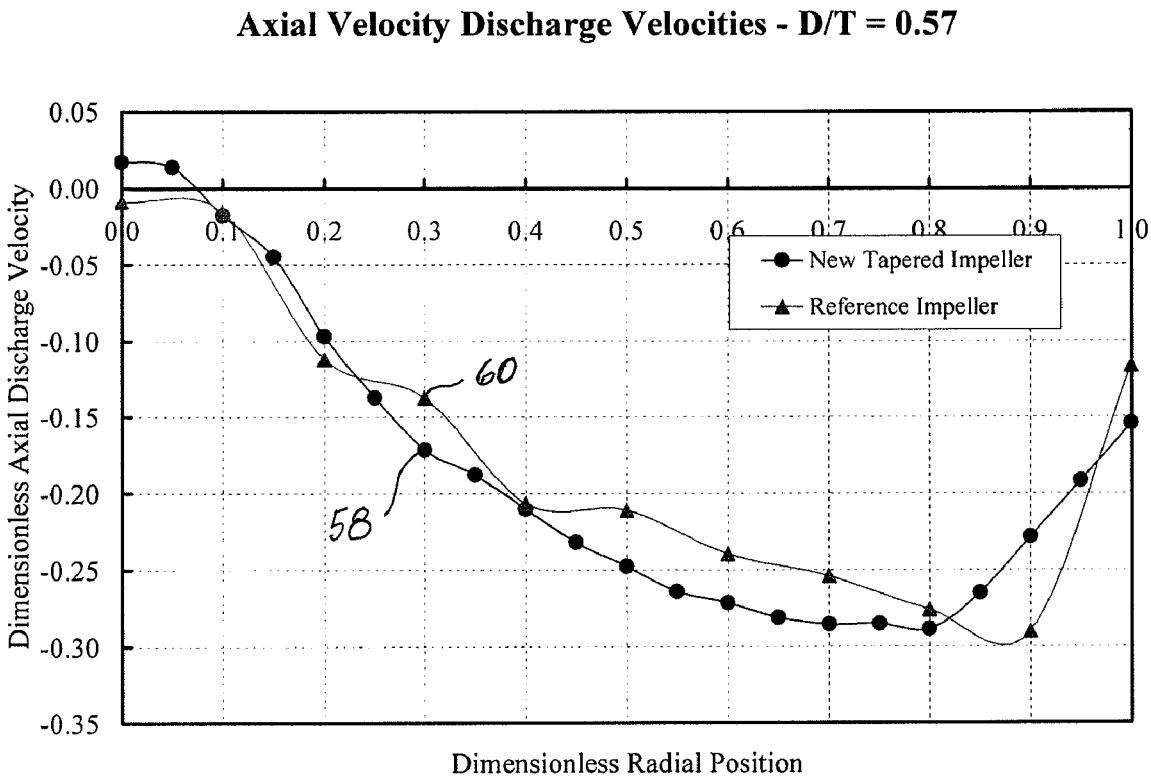
FIG. 6 is a graph showing the dimensionless axial discharge velocity versus dimensionless radial position of the disclosed impeller and a prior art impeller for a D/T ratio of 0.57.

The power number Np for a comparably sized prior art impeller—specifically, the impeller described in U.S. Pat. No. 5,052,892—is shown as broken line M in the graph of FIG. 5. The line M is below the line 56 in FIG. 5. This means that impeller 12 has a higher power number than the impeller disclosed in the '892 patent across the entire range of D/T ratios. The pumping capacity of impeller 12 is higher than the impeller disclosed in the '892 patent, as can be seen in FIG. 6. This increase in performance enables a smaller impeller 12 to be used and provide the performance comparable to a larger prior art impeller of a type described in the '892 patent. Other variables were held constant.

As shown in FIG. 6, the axial discharge velocity, expressed as a dimensionless number, is plotted for points taken along the length of the impeller blade from the root (0.0) to the blade tip (1.0). For example, the value "0.5" on the horizontal axis represents measurements taken halfway between the root and tip of the impeller blade. The plot is made for a D/T ratio of 0.57. The data points for the disclosed impeller 12, shown as circles 58, form a curve that is flatter than the curve formed by the data points of a comparably sized and powered prior art impeller described in U.S. Pat. No. 5,052,982, represented by triangles 60. The flatter curve is desirable since the discharge velocity is more uniform along the length of the impeller blade 24. Also, the maximum axial discharge velocity is closer to the blade root with impeller blade 24 than with the prior art impeller described in the '892 patent.

Figure 7:
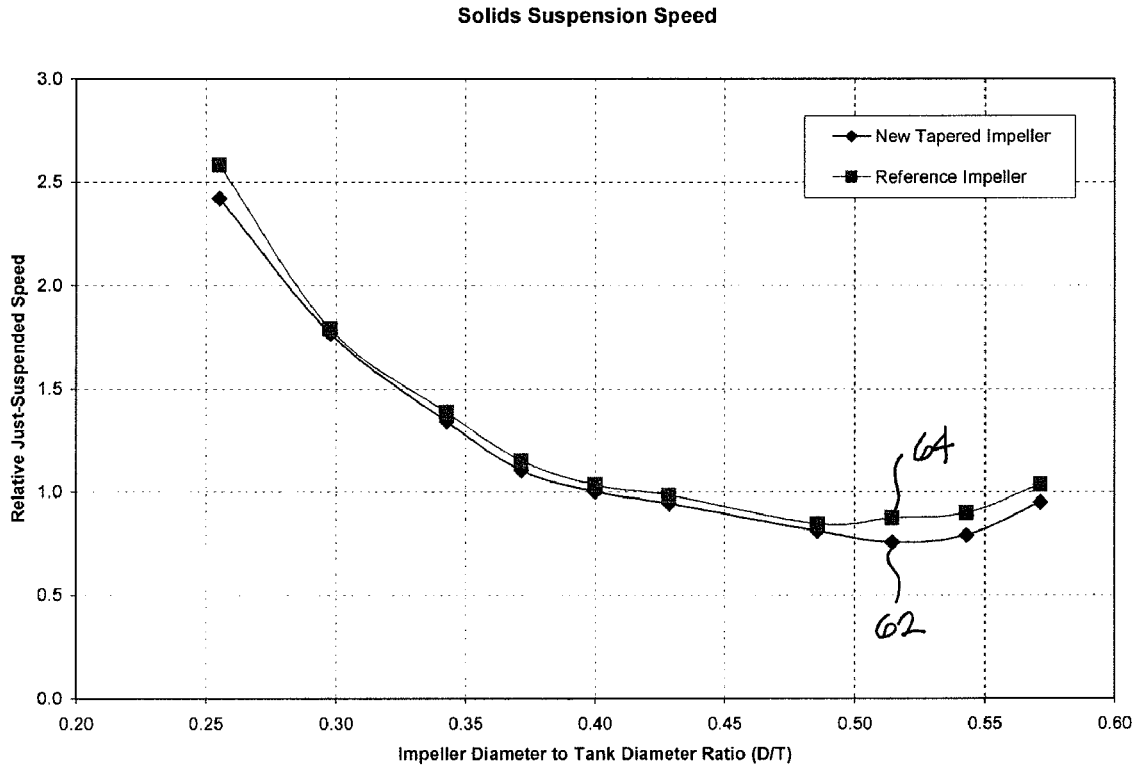
FIG. 7 is a graph showing the relative just-suspended speed versus D/T ratio for the disclosed impeller and a prior art impeller.
Figure 8:
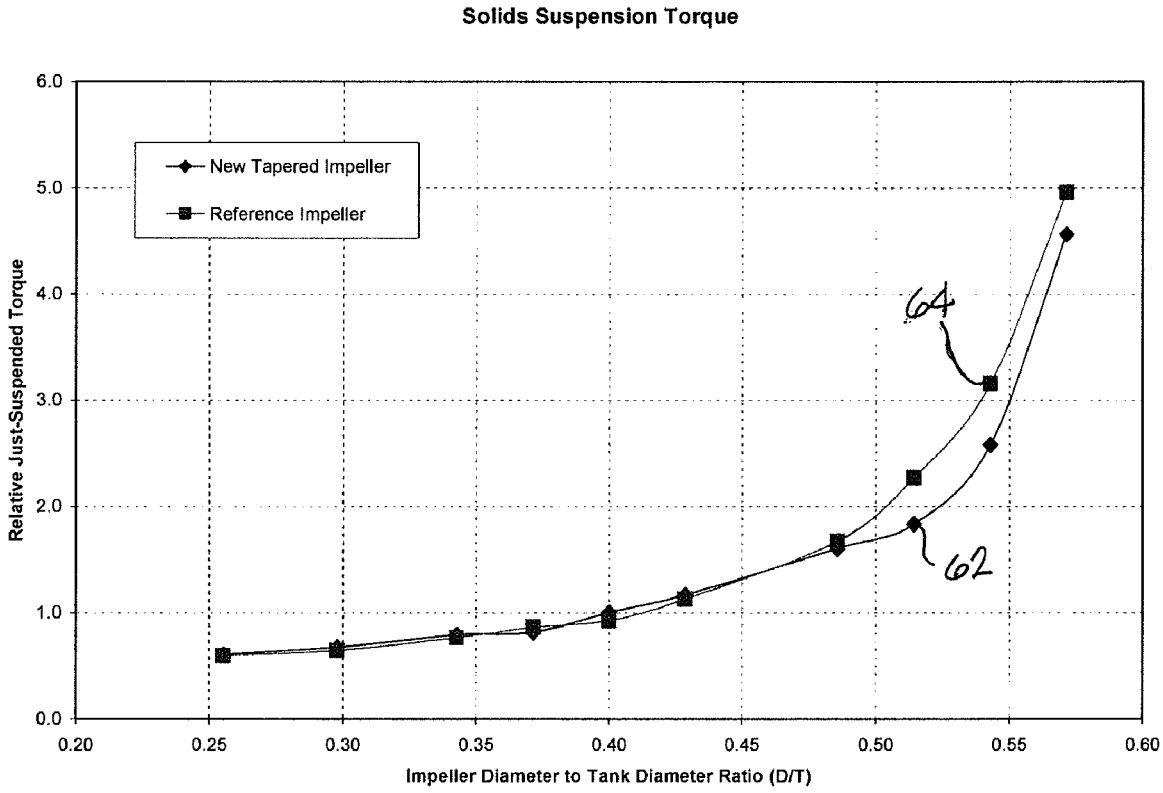
FIG. 8 is a graph showing the relative just-suspended torque versus D/T ratio for the disclosed impeller and a prior art impeller.
Figure 9:
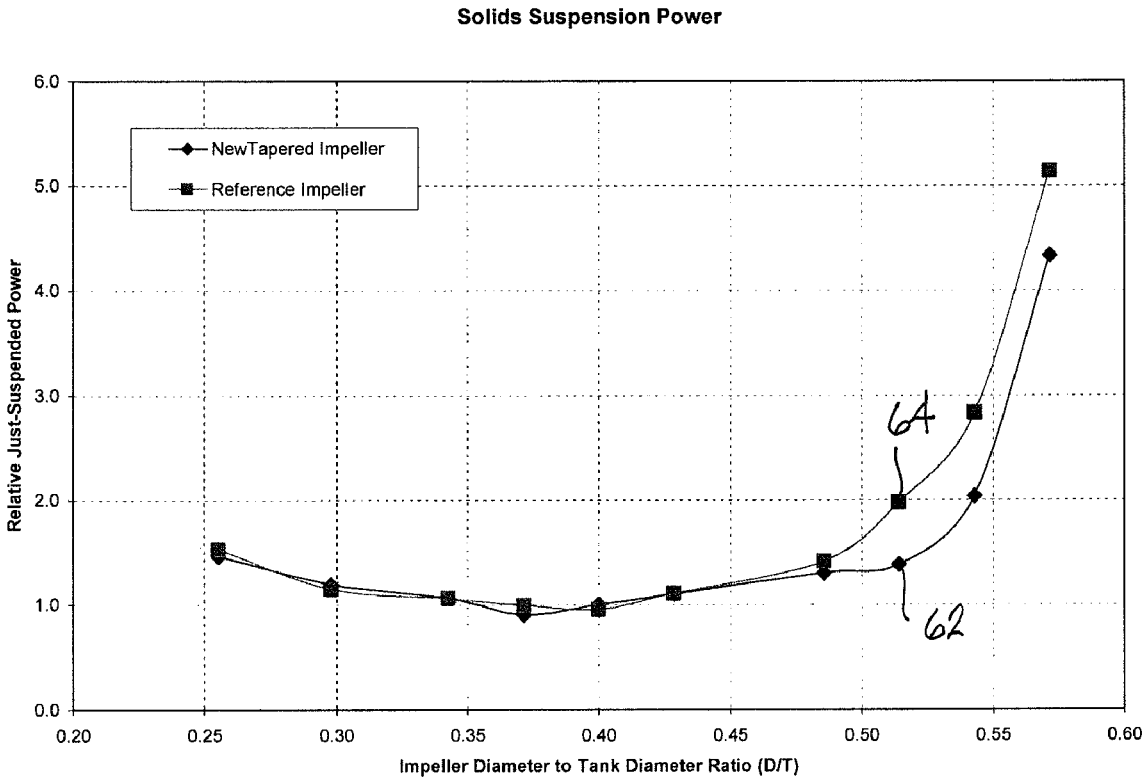
FIG. 9 is a graph showing the relative just-suspended power versus D/T ratio for the disclosed impeller and a prior art impeller.

FIGS. 7, 8 and 9 show the performance characteristics of the disclosed impeller 12 and the prior art impeller described in the '892 patent in a fluid having suspended solids. In FIG. 7, the relative just-suspended speed is plotted against the impeller diameter to tank diameter ratio D/T. The two impellers are comparably sized and other variables are held constant. The data points for the disclosed impeller 12 are shown as diamonds 62. This curve is relatively flatter than the curve comprised of prior art data points 64. The flatter curve shows that the performance of the disclosed impeller 12 is not as affected by changes in the D/T ratio as the impeller of the '892 patent.

As shown in FIG. 8, relative just-suspended torque is plotted against D/T ratios for the impeller 12 and the comparably sized impeller of the '892 patent. Other variables are held constant. The curve for the disclosed impeller 12, represented by points 62, shows that less torque is required to achieve a given level of suspension when compared to the prior art impeller of the '892 patent, represented by the curve made up of squares 64. Accordingly, the disclosed impeller 12 is more efficient and requires less energy to achieve a given level of solid suspension over a variety of D/T ratios. The performance is particularly noticeable in ratios between about 0.5 to 0.58.

As shown in FIG. 9, the power requirements of the disclosed impeller 12, represented by data points 62, shows that the disclosed impeller requires less energy to achieve a given level of solid suspension than the comparably sized prior art impeller of the '892 patent, as shown by the curve made up of squares 64. Other variables are held constant.

In conclusion, the curves of FIGS. 5-9 show the improved performance characteristics of the disclosed impeller 12, both in uniformity of performance over a range of D/T ratios, and for low energy requirements to achieve a given level of pumping performance or solid suspension. These graphs show marked improvement over the prior art impeller described in the '892 patent.

While the forms of apparatus herein disclosed constitute preferred embodiments of the invention, it should be understood that the claimed invention is not limited to these precise forms, and that modifications and variations thereof may be made without departing from the scope of the invention.

What is claimed is:

1. A mixer impeller comprising:

a central hub; and a plurality of blades attached to and extending radially outwardly from said hub such that leading edges thereof are inclined upwardly from trailing edges thereof, each of said blades having a root attached to said hub, a tip, a first, substantially rectilinear crease extending along substantially an entire length of said blade dividing said blade into a leading portion and a trailing portion, said leading and trailing portions each being substantially flat, and meeting at said first crease such that said leading portion is angled downwardly from said trailing portion, and a second, substantially rectilinear crease extending from a portion of said leading edge of said leading portion between said root and said tip diagonally along said leading portion to said tip, said second crease intersecting said tip at a point spaced toward said leading edge from a point where said first crease intersects said tip, said second crease forming a tip portion of said leading portion that meets a remainder of said leading portion such that said tip portion is angled downwardly from said remainder of said leading portion.

2. The mixer impeller of claim 1 wherein each of said blades is formed from substantially flat, plate material.

3. The impeller of claim 1 wherein, for each of said blades, said tip is substantially square in shape.

4. The impeller of claim 1 wherein, for each of said blades, said leading portion makes an angle of about 155° with said trailing portion along said first crease.

5. The impeller of claim 1 wherein, for each of said blades, said tip portion makes an angle of about 13.5° with said remainder of said leading portion.

6. The impeller of claim 1 wherein, for each of said blades, said trailing portion tapers in its width toward said tip.

7. The impeller of claim 1 wherein, for each of said blades, a portion of said leading edge extending along said tip portion makes an angle of about 2° with a plane perpendicular to an axis of rotation of said hub.

8. The impeller of claim 1 wherein said leading edge is beveled at about 45°.

9. The impeller of claim 1 wherein said impeller blades are made from a corrosion-resistant material.

10. The impeller of claim 9 wherein said corrosion-resistant material is stainless steel.

11. A mixer impeller comprising:

a central hub having an axis of rotation; and a plurality of blades, each of said blades being formed from substantially flat, plate material of and attached to and extending radially outwardly from said hub such that leading edges thereof are beveled at about 45° and are inclined upwardly from trailing edges thereof, each of said blades having a root attached to said hub, a substantially square tip, a first, substantially rectilinear crease extending along an entire length of said blade, dividing said blade into a substantially flat leading portion and a substantially flat trailing portion that tapers in its width toward said tip, said leading and trailing portions meeting at said first crease such that said leading portion is angled downwardly from said trailing portion, making an angle of about 155° therewith, and a second, substantially rectilinear crease extending from a portion of said leading edge of said leading portion between said root and said tip diagonally along said leading portion to said tip, said second crease intersecting said tip at a point spaced toward said leading edge from a point where said first crease intersects said tip, said second crease forming a substantially flat tip portion of said leading portion that meets a remainder of said leading portion such that said tip portion is angled downwardly from said remainder of said leading portion, making an angle of about 13.5° therewith and an angle of about 2° with a plane perpendicular to said axis of rotation of said hub.

12. An impeller blade for a mixer impeller comprising:

a root adapted to be attached to a hub;

a tip;

a first, substantially rectilinear crease extending along substantially an entire length of said blade dividing said blade into a leading portion and a trailing portion, said leading and trailing portions each being substantially flat and meeting at said first crease such that said leading portion is angled downwardly from said trailing portion; and a second, substantially rectilinear crease extending from a portion of said leading edge of said leading portion between said root and said tip diagonally along said leading portion to said tip, said second crease intersecting said tip at a point spaced toward said leading edge from a point where said first crease intersects said tip, said second crease forming a tip portion of said leading portion that meets a remainder of said leading portion such that said tip portion is angled downwardly from said remainder of said leading portion.

13. The impeller of claim 12 wherein said leading portion makes an angle of about 155° with said trailing portion along said first crease.

14. The impeller of claim 12 wherein said tip portion makes an angle of about 13.5° with said remainder of said leading portion.

15. The impeller of claim 12 wherein said leading edge is beveled at about 45°.

16. The impeller of claim 12 wherein said trailing portion tapers in its width toward said tip.

17. The impeller of claim 12 wherein said first crease extends along an entire length of said blade.

18. An impeller blade for a mixer impeller comprising:

a substantially flat blade body;

said body having a root adapted to be attached to a hub and a substantially square tip;

a first, substantially rectilinear crease extending along an entire length of said blade, said first crease dividing said blade into a substantially flat leading portion and a substantially flat trailing portion that tapers in its width toward said tip, said leading and trailing portions meeting at said first crease such that said leading portion is angled downwardly from said trailing portion, making an angle of about 155° therewith;

said leading portion having a leading edge being beveled at about 45°; and a second, substantially rectilinear crease extending from a portion of said leading edge of said leading portion between said root and said tip diagonally along said leading portion to said tip, said second crease intersecting said tip at a point spaced toward said leading edge from a point where said first crease intersects said tip, said second crease forming a substantially flat tip portion of said leading portion that meets a remainder of said leading portion such that said tip portion is angled downwardly from said remainder of said leading portion, making an angle of about 13.5° therewith and an angle of about 2° with a plane perpendicular to said axis of rotation of said hub.

* * * * *